US006502527B1

(12) United States Patent
Danielson

(10) Patent No.: US 6,502,527 B1
(45) Date of Patent: Jan. 7, 2003

(54) SUBMARINE TORPEDO TUBE UNDERWATER VEHICLE RECOVERY SYSTEM

(75) Inventor: Thomas Roger Danielson, San Jose, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/946,306

(22) Filed: Sep. 5, 2001

(51) Int. Cl.[7] ..... B63G 8/00
(52) U.S. Cl. ..... 114/312; 114/316
(58) Field of Search ..... 114/312, 313, 114/322, 316, 50; 405/190, 191; 294/66.1, 66.2; 89/5

(56) References Cited

U.S. PATENT DOCUMENTS 3,451,224 A * 6/1969 Colechia et al. ..... 405/190
4,304,189 A * 12/1981 Wright ..... 114/254
5,315,795 A 5/1994 Chae et al.
5,447,115 A * 9/1995 Moody ..... 114/312

FOREIGN PATENT DOCUMENTS

DE 3737342 * 5/1989 ..... 114/312

* cited by examiner

*Primary Examiner*—S. Joseph Morano
*Assistant Examiner*—Ajay Vasudeva
(74) *Attorney, Agent, or Firm*—Edward J. Howard; Duane Morris

(57) ABSTRACT

A system for recovering submerged devices uses two recovery tubes of an underwater recovery vehicle. A recovery member is disposed within a first recovery tube. A second recovery tube receives the submerged device. To recover the submerged device, the recovery member is extended from the first recovery tube. A capture arm, which is pivotally attached to the end of the recovery member is extended. The extended capture arm is engaged with the submerged device. The capture arm is adjusted to align the submerged device with the second recovery tube. The recovery member is retracted to recover the submerged device into the second recovery tube. Because the recovery member is not disposed within the same recovery tube that is used to house the retrieved submerged device, the submerged device may have an outer diameter approximately equal to the inner diameter of the recovery tube.

23 Claims, 6 Drawing Sheets

SUBMARINE TORPEDO TUBE UNDERWATER VEHICLE RECOVERY SYSTEM

GOVERNMENTAL INTEREST

This invention was prepared under government contract N00024-96-C-6120. The United States Government has a non-exclusive, non-transferable, paid-up license in this invention.

FIELD OF THE INVENTION

The present invention relates to underwater recovery systems, and specifically to an underwater recovery system using submarine torpedo tubes.

BACKGROUND

Unmanned underwater vehicles (UUVs) are used in research and military applications. The anticipated missions for these vehicles are quite diverse; however, some of the missions require the capability to retrieve a UUV by a submarine or other underwater recovery vehicle. This is often the case when the recovery of the UUV must be covert. Retrieval of a UUV is typically desired for several reasons including, the UUV may have a cost of several million dollars, the need to retrieve the intelligence data gathered by the UUV, and the need to prepare the vehicle for a subsequent mission.

Many options have been considered for submarine retrieval of UUVs. One option includes attaching it to the outside of the pressure hull of the submarine. However, this requires the development of an external retrieval system and increases the acoustic noise emitted by the submarine. Furthermore, a UUV attached externally to the hull of the submarine is inaccessible for data gathering and maintenance. Scuttling the UUV after it has accomplished its mission is expensive and does not allow retrieval of UUV data gathered during the mission.

Using a surface ship to retrieve the UUV destroys the clandestine nature of the mission. Further, this requires that a submarine carry multiple UUVs for multiple missions. Use of a line and hook system launched from a torpedo tube to connect with a line and hook system deployed from a returning UUV has also been considered, but this method does not align the returning UUV with the torpedo tube and launchway resulting in possible damage to the UUV or hang up when the UUV is retracted into the ship.

Without extensive modification of a submarine, the torpedo tube hatch is the preferred submarine hull opening with a large enough aperture to allow entry of the UUV upon retrieval. Torpedo tube retrieval is complicated by several factors. Typical UUV designs are weight critical and therefore, are designed with delicate control surfaces, and minimal impact and load carrying capability beyond the loads imposed by hydrodynamic forces. Even under moderate ship speed, a complex flow field exists in the torpedo tube shutter area, which exerts significant lateral forces on any vehicle attempting to exit or enter the torpedo launch system's shutterway. Typically, space within a torpedo room is limited, thus suggesting that a torpedo tube recovery system retrieve the UWV into the torpedo tube tail first because of the possibility of insufficient space to turn the UUV around for a subsequent launch. Further, significant submarine modifications using a new hull penetration apparatus or replacing a major ship component are cost prohibitive. Single torpedo tube retrieval systems have been considered. However, single torpedo tube systems do not allow UUV designs to take maximum advantage of the full size of the torpedo tube, because some space must be left to accommodate a retrieval system in the torpedo tube. Thus a need exists for an underwater recovery system which overcomes the above obstacles and disadvantages.

SUMMARY OF THE INVENTION

A system and method for recovering a submerged device with an underwater recovery vehicle utilize the underwater recovery vehicle's recovery tubes. A recovery member is disposed within a first recovery tube. A second recovery tube receives the submerged device. To recover the submerged device, the recovery member is extended from the first recovery tube. The recovery member has a proximate end and a distal end, and the proximate end of the recovery member remains within the first recovery tube. A capture arm is extended from the distal end of the recovery member. The capture arm is engaged with the submerged device. The submerged device is aligned with the second recovery tube. The recovery member is retracted to recover the submerged device into the second recovery tube.

BRIEF DESCRIPTION OF THE DRAWINGS

The above and other advantages and features of the present invention will be better understood from the following detailed description of the preferred embodiments of the invention, which is provided in connection with the accompanying drawings. The various features of the drawings may not be to scale. Included in the drawing are the following figures.

DETAILED DESCRIPTION

Figure 1A:
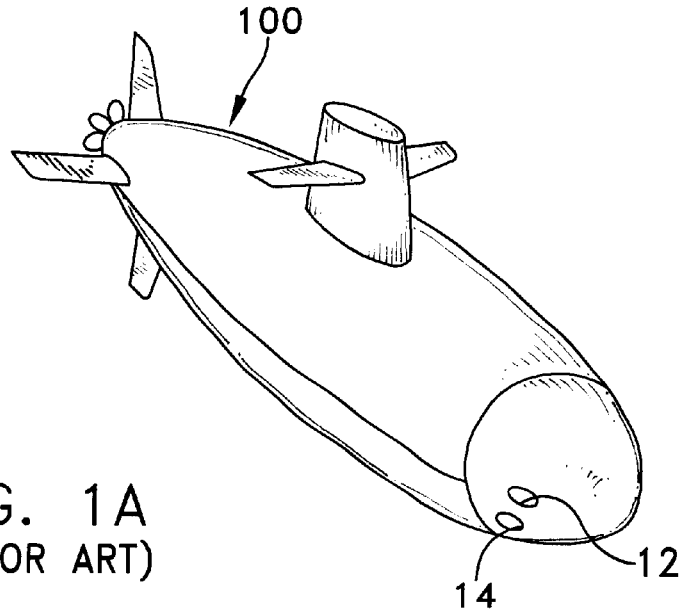
FIG. 1A (PRIOR ART)
FIG. 1A (Prior Art) is a perspective view of an underwater recovery vehicle illustrating the torpedo ports.

This description of preferred embodiments is intended to be read in connection with the accompanying drawing(s), which are to be considered part of the entire written description of this invention. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Figure 1B:
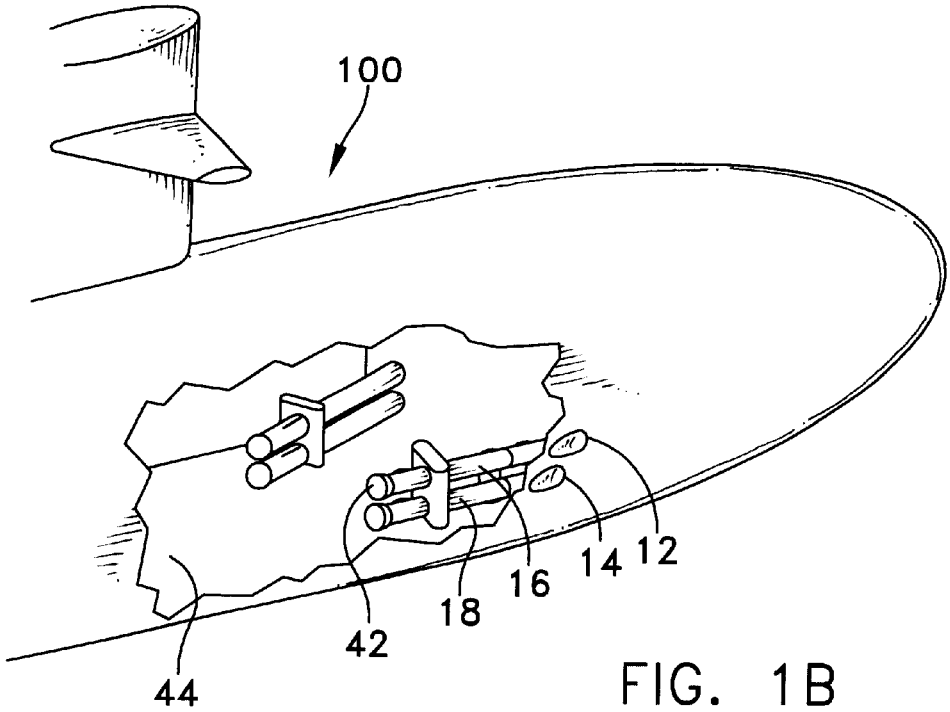
FIG. 1B (PRIOR ART)
FIG. 1B (Prior Art) is a perspective view of an underwater recovery vehicle illustrating a cut away view of the recovery tubes.

FIGS. 1A and 1B are perspective views of an underwater recovery vehicle (e.g., submarine) illustrating recovery ports 12 and 14 (e.g., torpedo ports) and additionally, a cut away view of recovery tubes 16 and 18 (e.g., torpedo tubes), respectively. Underwater recovery vehicle 100 comprises at least one pair of recovery tubes 16 and 18 on the same side of the recovery vehicle 100. Each recovery tube comprises an inner cavity (not shown in FIG. 1) and a recovery tube hatch 42. As will be explained herein, a recovery member for retrieving a submerged device (such as underwater vehicle 40 in FIG. 3C), may be disposed in the recovery tube cavity. To recover an submerged device the recovery member is extended from the recovery tube, in which it is disposed. A capture arm is extended from the end of the recovery member. The submerged device is engaged with the capture arm. Then the submerged device is retrieved into the other recovery tube by retracting the recovery member. Recovery tube hatch 42 provides a water tight seal to prevent seawater from entering the recovery room 44. The pair of recovery tubes may be located on either the port or starboard side of underwater recovery vehicle 100. The underwater recovery vehicle 100 may also comprise a second pair of recovery tubes. The underwater recovery vehicle 100 may be any appropriate underwater vehicle having at least two recovery tube like structures located on one side of the vehicle, such as, for example, a submarine or a submersible rescue/exploratory vehicle. In an exemplary embodiment of the invention, underwater recovery vehicle 100 is a submarine. In another exemplary embodiment of the invention, underwater recovery vehicle 100 is a SSN 688 class submarine (i.e., Los Angeles class).

In accordance with various embodiments of the invention, the submerged device 40 (see FIG. 3C) may be an underwater vehicle, an unmanned underwater vehicle, and/or any submerged device capable of be retrieved within a recovery tube 16, 18.

Figure 2:
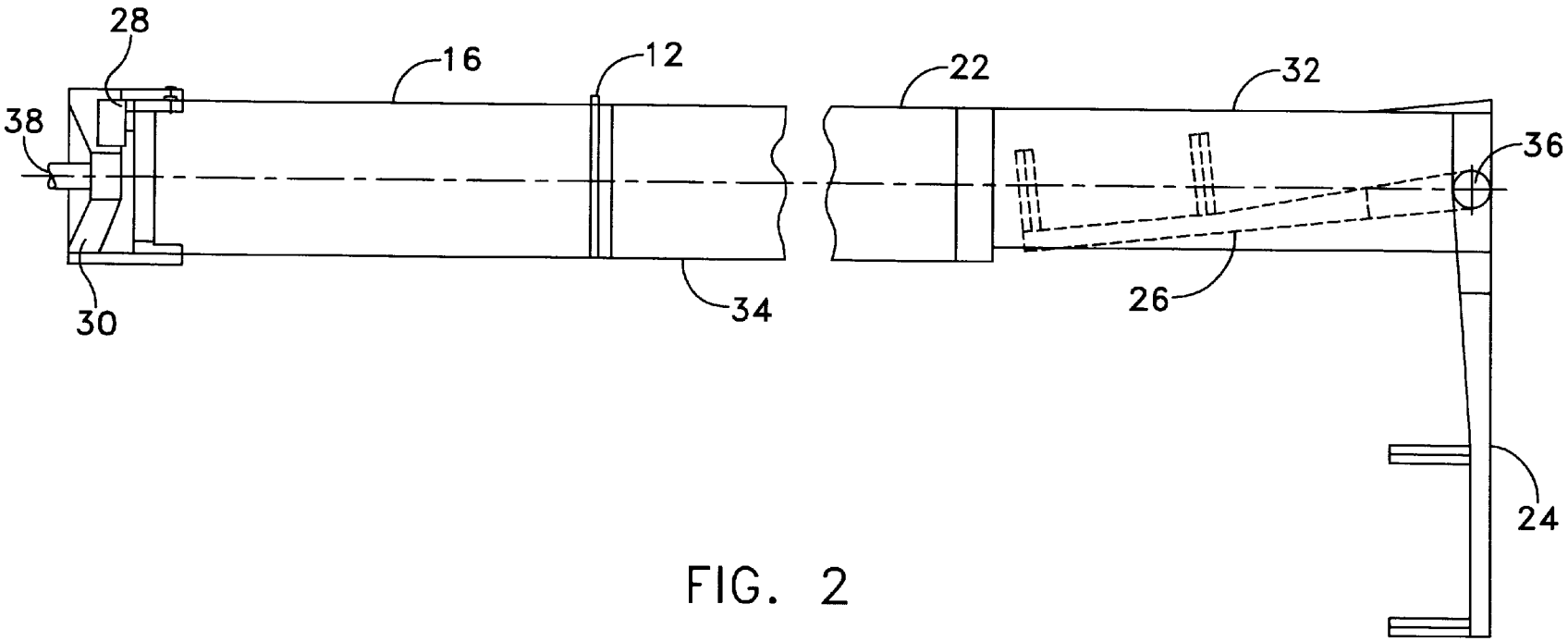
FIG. 2 is a cross sectional view of an exemplary recovery tube and extended recovery member, in accordance with the present invention.

FIG. 2 is a cross sectional view of an exemplary recovery tube 16 and extended recovery member 22, in accordance with the present invention. Recovery member 22 is disposed within recovery tube 16. Recovery member 22 may be disposed in any available recovery tube, for example, recovery tube 14. Recovery member 22 may be any recovery member capable of being extended from recovery tube 16 beyond recovery port 12. In an exemplary embodiment of the invention, recovery member 22 is a telescopic structure. As recovery member 22 is extended, the proximate end of recovery member 22 remains within the recovery tube 16, and the distal end of recovery member 22 is extended beyond the body profile of the underwater recovery vehicle 100. Capture arm 24 is pivotally connected to the distal end of recovery member 22 by hinge 36. Capture arm 24 is shown in the extended position in FIG. 2. Dashed line structure 26 indicates the positioning of capture arm 24 in the stowed position. Capture arm 24 is placed in the stowed positioned to allow recovery member 22 to be retracted into recovery tube 16.

Figures 3A, 3B, 3C:
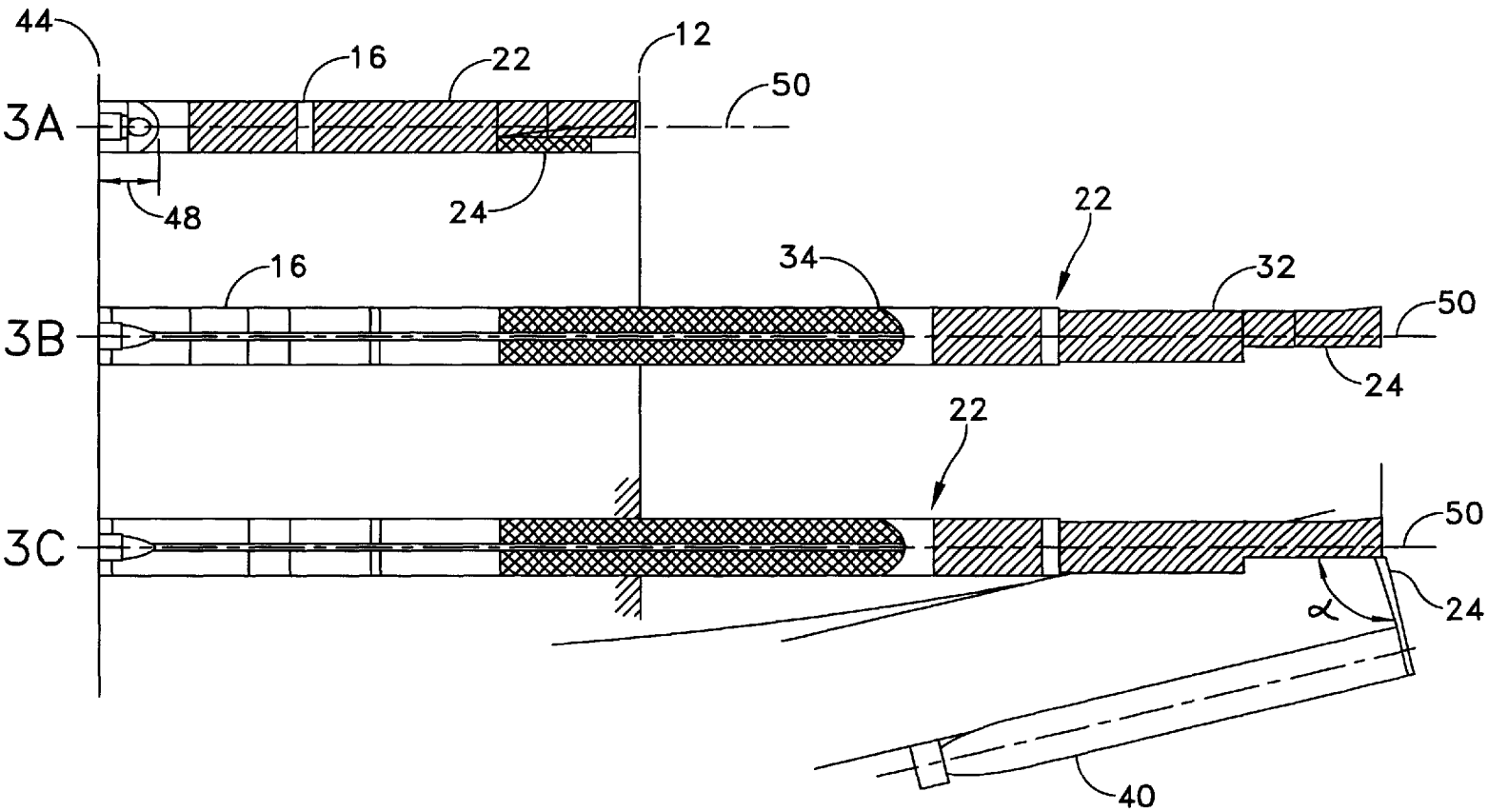
FIG. 3A is a cross sectional view of an exemplary recovery member retracted into a recovery tube, in accordance with the present invention.
FIG. 3B is a cross sectional view of a recovery member extended and capture arm stowed, in accordance with an exemplary embodiment of the invention.
FIG. 3C is a cross sectional view of extended recovery member and extended capture arm engaged with submerged device, in accordance with an exemplary embodiment of the invention.

FIG. 3A is a cross sectional view of recovery member 22 retracted into recovery tube 16, in accordance with an exemplary embodiment of the present invention. In an exemplary embodiment of the invention, the length of recovery tube 16 between the recovery tube hatch 44 and the recovery port 12 is 254.6 inches (6.47 meters). This dimension of 254.6 inches (6.47 meters) is measured when recovery hatch 44 is closed and when the muzzle door of recovery port 12 is closed. The dimension indicated by arrow 48 shows the space occupied by bi-stem actuator 38 and rotary drive 28. In an exemplary embodiment of the invention, dimension 48 is about 24 inches (609.6 mm). Capture arm 24 is stowed to fit within the diameter of the inner cavity of the recovery tube 16. In an exemplary embodiment of the invention, the diameter of the inner cavity of the recovery tube 16 is about 21 inches (533.4 mm).

FIG. 3B is a cross sectional view of recovery member 22 extended and capture arm stowed, in accordance with an exemplary embodiment of the invention. In an exemplary embodiment of the invention, inner portion 32, outer portion 34, or both of recovery member 22 is rotatable about the recovery tube 16 centerline 50. This rotation facilitates aligning capture arm 24 with the submerged device 40 (see FIG. 3C) to be retrieved.

FIG. 3C is a cross sectional view of extended recovery member 22 and extended capture arm 24 engaged with submerged device 40, in accordance with an exemplary embodiment of the invention. Capture arm 24 is extended to an angle, $\alpha$, to engage capture arm 24 with submerged device 40. To accomplish a safe and effective capture maneuver, the angle, $\alpha$, is the angle necessary to ensure that neither submerged device 40 nor the outer hull of underwater recovery vehicle 100 is damaged due to contact. In an exemplary embodiment of the invention, the angle $\alpha$, is an obtuse angle. Factors such as hydrodynamic forces exerted on the outer hull of underwater recovery vehicle 100, submerged device 40, recovery member 22, and capture arm 24, must be considered to accomplish a safe and effective capture maneuver. Other factors include the speed and direction of underwater recovery vehicle 100 and the speed and direction of submerged device 40. Thus, engaging submerged device 40 with capture arm 24 comprises extending capture arm 24 to an appropriate angle $\alpha$, and optionally rotating capture arm 24 about center line 50 appropriately. As shown in FIG. 3C, capture arm 24 engages with the forward end of the submerged device 40. Typically, this configuration reduces flow turbulence.

Figure 6:
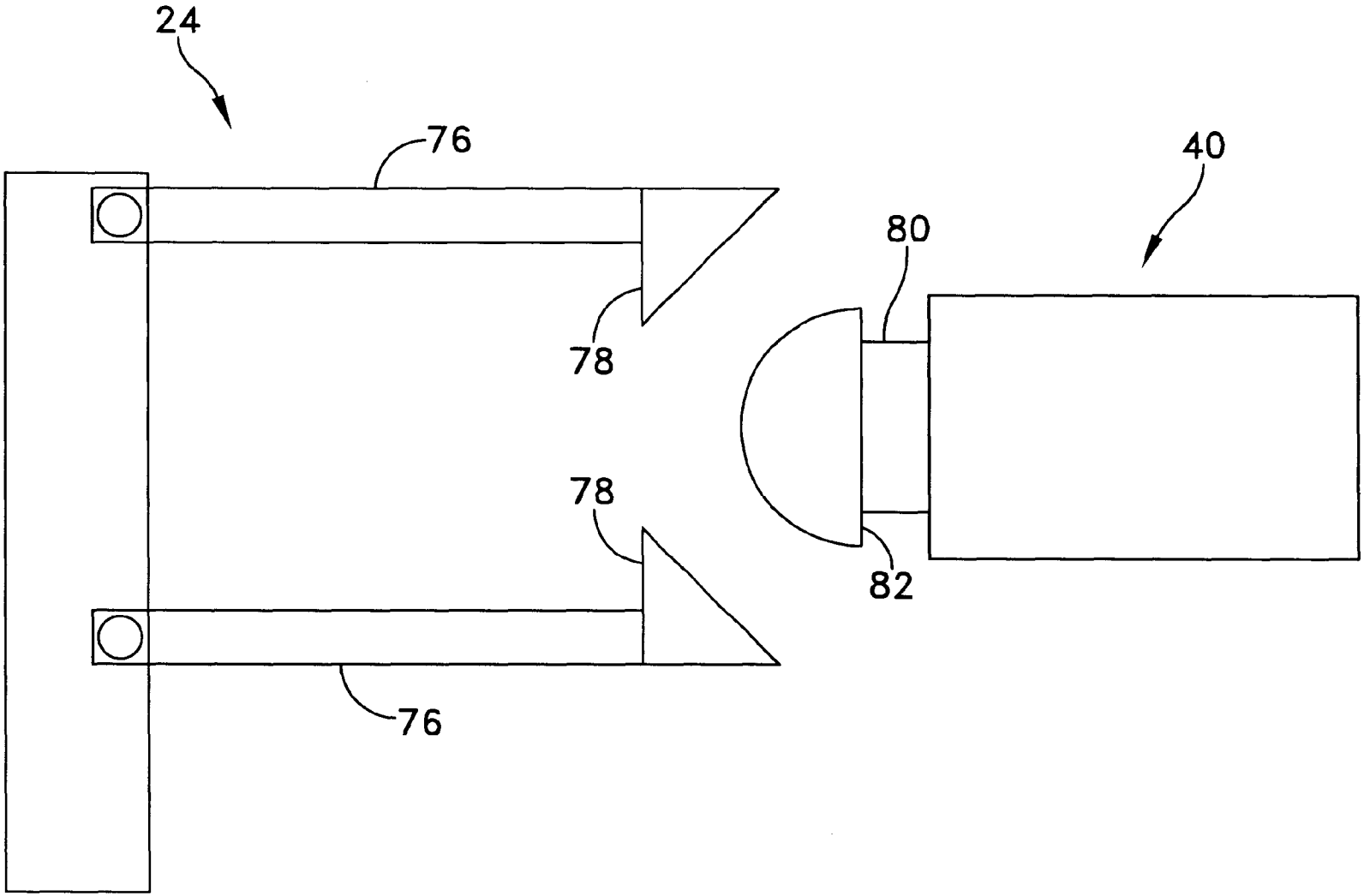
FIG. 6 is an illustration of a capture arm in accordance with an embodiment of the present invention.

FIG. 6 is an illustration of an exemplary configuration for capture arm 24, in accordance with an embodiment of the invention. Capture arm 24 comprises a plurality of spring loaded fingers 76. Two fingers 76 are shown, however capture arm 24 may comprise more than two finger 76. Each spring loaded finger 76 comprised a retaining edge 78 for retaining the forward end of submerged device 40 upon engagement. Retaining edges 78 engage with slot 80. Upon engagement, retaining edges 78 mate with engagement edge 82, thus preventing submerged device 40 from being released. In an alternate embodiment of the invention, engagement edge 82 comprises localized notches (not shown) for preventing submerged device 40 from rotating.

Referring to FIGS. 2, 3A, 3B, and 3C, in an exemplary embodiment of the invention, recovery member 22 is a two part telescoping structure comprising an inner portion 32 and an outer portion 34. Inner portion 32 is disposed within outer portion 34. When recovery member 22 is fully retracted, inner portion 32 is disposed completely within outer portion 34 (see FIG. 3A). When the recovery member 22 is fully extended, the proximate end of inner portion 32 remains disposed within outer portion 34, and the distal end of inner portion 32 is extended beyond outer portion 34 (see FIGS. 3B and 3C). In this embodiment, capture arm 24 is pivotally connected to the distal end of inner portion 32 by hinge 36. In alternate embodiments of the invention, recovery member 22 comprises telescopic structures having more than two parts. The outer portion 34 may comprise composite materials such as graphite epoxy, or fiberglass, for example. Inner portion 32 may comprise materials such as titanium, aluminum, or stainless steel.

Recovery member 22 may be extended and retracted by any of several means. In an exemplary embodiment of the invention, as shown in FIG. 2, recovery member 22 is extended and retracted by a bi-stem actuator 38. The bi-stem drive is anchored to the recovery tube, adjacent to the recovery tube inner door 42. The bi-stem system can provide sufficient thrust to extend the inner (smaller diameter) portion 32 of recovery member 22 to its full extension and then also slide out the outer (larger diameter) portion 34 of recovery member 22 to a position partially extended out of the recovery tube and hold the entire assembly during the recover operation. The bi-stem system can also reverse the actuation, thus retracting the assembly into the recovery tube. In another exemplary embodiment of the invention, recovery member 22 is extended and retracted by a hydraulic system. A hydraulic recovery system in accordance with the present invention may comprise fluids such as oil or seawater. One example of a seawater hydraulic recovery system comprises seawater pumps and valves for extending and retracting recovery member 22. In yet another embodiment of the invention, recovery member 22 is extended and retracted by a pneumatic system. However, a pneumatic system may only be appropriate in underwater recovery vehicles that do not operate at depths wherein the sea water pressure makes the pneumatic system difficult to use and potentially dangerous. Thus, even though an embodiment of the invention may comprise a pneumatic system, a pneumatic system may not be practicable for certain applications, such as military submarines.

Still referring to FIG. 2, rotary drive 28 is positioned on the bulkhead of the inner (smaller diameter) portion 32 of recover member 22. Rotary drive 28 rotates inner portion 32, which in turn rotates capture arm 24. This rotation aids in aligning the submerged device 40 with recovery tube 18 after capture arm 24 and submerged device 40 have engaged.

If a bi-stem actuator 38 is used as the extend and retract mechanism, bulkhead 30 may comprise a bearing bore through its center to accommodate and support the bi-stem actuator 38. If a seawater hydraulic system is used, bulkhead 30 will provide a seal in the recovery tube sufficient to withstand the pressure differential necessary to actuate and hold the recovery system in its extended position. In a seawater actuation system the bulkhead 30 will also mount at least one pump and valve to implement the seawater actuation system.

Figure 4A:
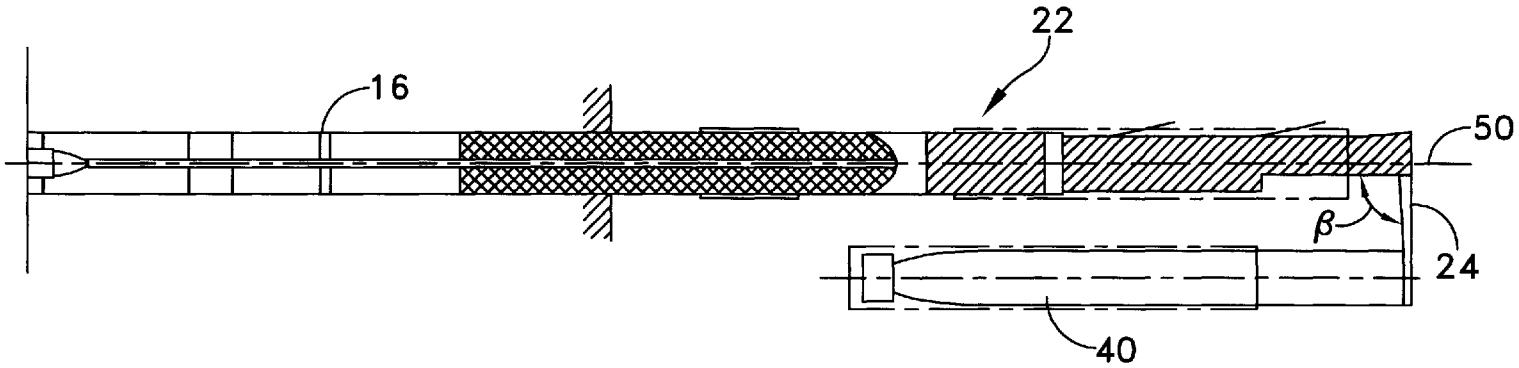
FIG. 4A is a cross sectional view of extended recovery member and capture arm engaged with a submerged device, wherein the submerged device is being coaxially aligned with recovery tube, in accordance with an exemplary embodiment of the invention.

FIG. 4A is a cross sectional view of extended recovery member 22 and capture arm 24 engaged with submerged device 40, wherein submerged device 40 is being coaxially aligned with recovery tube 18 (recovery tube 18 not shown in FIG. 4A). During the alignment process, submerged device 40 is aligned with recovery port 14 to facilitate retrieval of the submerged device 40 into recovery tube 18, in accordance with an exemplary embodiment of the invention. Capture arm 24 is retracted to angle $\beta$ to accomplish this alignment. In an exemplary embodiment of the invention, angle $\beta$ is less than angle $\alpha$. Additionally, capture arm 24 may be rotated about centerline 50 to accomplish the alignment of submerged device 40 with recovery tube 18.

Figure 4B:
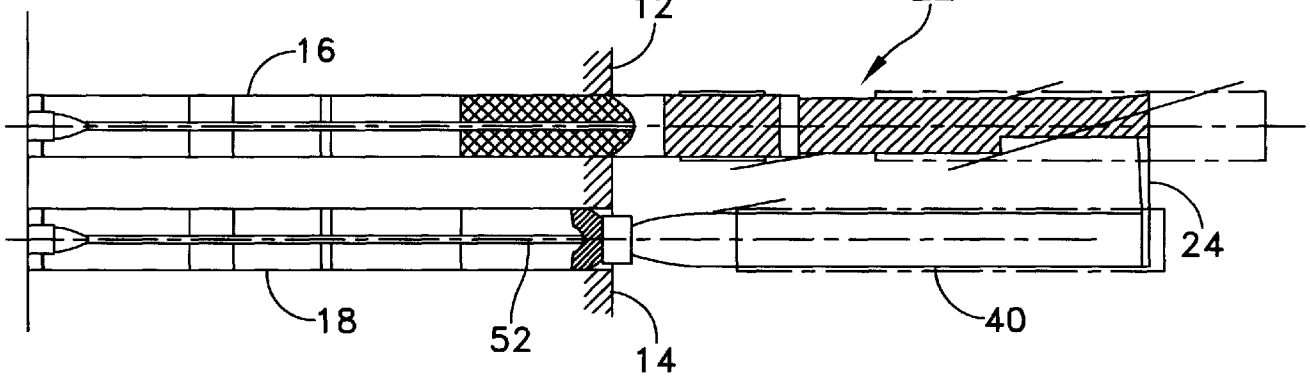
FIG. 4B is a cross sectional view of submerged device entering a recovery tube, in accordance with an exemplary embodiment of the invention.
Figure 4C:
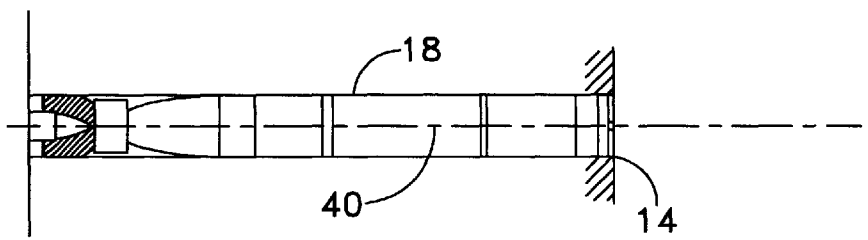
FIG. 4C is cross sectional view of an submerged device stowed in a recovery tube, in accordance with an exemplary embodiment of the invention.

FIG. 4B is a cross sectional view of submerged device 40 entering recovery tube 18, in accordance with an exemplary embodiment of the invention. As recovery member 22 is retracted, submerged device 40 is moved closer to recovery tube 18. As retraction of recovery member 22 continues, the aft end of submerged device 40 enters recovery tube 18 through recovery port 14. Recovery member 22 continues to be retracted, which inserts submerged device 40 further into recovery tube 18. FIG. 4C is cross sectional view of submerged device 40 stowed in recovery tube 18, in accordance with an exemplary embodiment of the invention.

In an exemplary embodiment of the invention, a retraction device 52, which is disposed within recovery tube 18, is employed to retract the submerged device 40 and coaxially align the submerged device 40 with recovery tube 18. Retraction device 52 may be bi-stem actuated, hydraulically controlled, and/or pneumatically controlled. In one embodiment of the invention, retraction device 52 engages the aft end of submerged device 40. Retraction: device 52 may attach to the shaft (not shown) or shroud of propeller (or thruster) of submerged device 40. For example, retraction device 52 may comprise a structure (similar in shape to a light bulb extractor) that attaches to the outer portion of the propeller shroud of submerged device 40. As submerged device 40 is retracted into recovery tube 18, the structure will center (coaxially align) the submerged device 40 within the recovery tube 18.

In an alternate embodiment of the invention, retraction device 52 is used to deploy the submerged device 40 from recovery tube 18. Deployment of submerged device 40 from recovery tube 18, via retraction device 52 is independent of recovery member 22.

Figure 5:
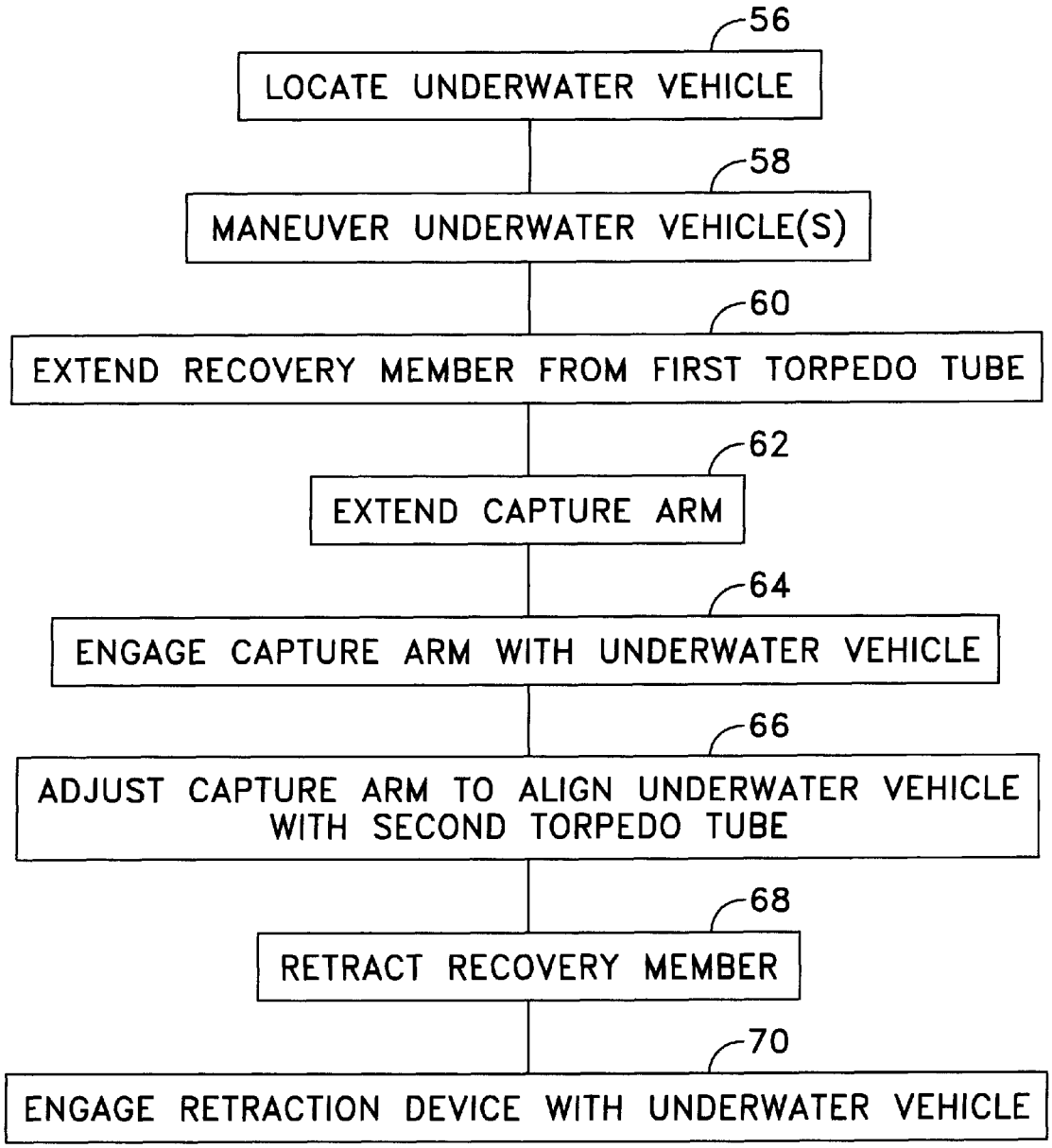
FIG. 5 is a flow diagram of an exemplary underwater recovery process in accordance with the present invention.

FIG. 5 is a flow diagram of an exemplary underwater recovery process in accordance with the present invention. Submerged device 40 is located in step 56. This may be accomplished through the use of a priori knowledge of the location of submerged device 40, or may be accomplished by searching for submerged device 40. Searching may be accomplished via any of several methods, including visually searching (if submerged device 40 is on the surface), acoustically searching (e.g., passive sonar, active sonar, underwater communications device), optical searching (e.g., laser searching device), or any combination thereof. Once the location of the submerged device 40 is known, the underwater recovery vehicle 100 and/or the submerged device 40 must be maneuvered such that the vehicles are close enough to each other to begin the retrieval process (step 58).

The recovery member 22 is extended from recovery tube 16 in step 60. The capture arm 24 is extended in step 62, in preparation for engaging the capture arm 24 with the submerged device 40, in step 64. In step 66, the capture arm 24 is adjusted to align the submerged device 40 with recovery tube 18. The capture maneuver may comprise any of several techniques. In an exemplary embodiment of the invention, underwater recovery vehicle 100 (FIG. 1) and/or submerged device 40 (FIGS. 3C, 4A, 4B, and 4C) are maneuvered to engage submerged device 40 with capture arm 24. This may require the speed of each vehicle to be less than approximately 3 knots. In another embodiment of the invention, capture arm 24, or submerged device 40, or both comprise homing devices to guide submerged device 40 into capture arm 24. Examples of homing devices include acoustic homing devices (active and/or passive), optic homing devices, magnetic homing devices, mechanical homing devices, and any combination thereof. Acoustic homing devices are particularly adapted for underwater applications and are well known in the art. Optic homing devices, such as a laser homing device, are also applicable due to the relatively short distance between the submerged device 40 and the capture arm 24 during the capture maneuver. Magnetic homing devices may be used in conjunction with any of the other homing devices, as well as stand alone homing devices. Mechanical homing devices may include devices such as cables and hooks.

Upon engaging capture arm 24 with submerged device 40, recovery member 22 is retracted to further insert the submerged device 40 into recovery tube 18, in step 68. Retraction device 52 is engaged with the submerged device 40 in step 70. Retraction device 52 may be engaged with the submerged device 40 at any time after the submerged device 40 is engaged with the capture arm 24. In an exemplary embodiment of the invention, the retraction device 52 is engaged with the submerged device 40 after the submerged device 40 enters the recovery tube 18 through recovery port 14.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A method for recovering a submerged device with an underwater recovery vehicle having a plurality of recovery tubes, said recovery tubes being non-coaxially aligned relative to one another, said method comprising the steps of:

extending a recovery member having a proximate end and a distal end from a first recovery tube of said plurality of non-coaxially aligned recovery tubes, said proximate end of said recovery member remaining within said first recovery tube;

extending a capture arm from said distal end of said recovery member;

engaging said capture arm with said submerged device;

aligning said submerged device with a second recovery tube of said plurality of non-coaxially aligned recovery tubes; and retracting said recovery member to recover said submerged device into said second recovery tube.

2. A method in accordance with claim 1, wherein said submerged device is an underwater vehicle.

3. A method in accordance with claim 1, wherein said step of extending said capture arm comprises pivotally extending said capture arm.

4. A method in accordance with claim 1, wherein said step of extending said capture arm comprises pivotally extending said capture arm to form an obtuse angle with said recovery member.

5. A method in accordance with claim 1, wherein said step of extending said recovery member comprises extending a telescoping recovery member comprising an outer portion and an inner portion disposed within said outer portion, said inner portion having a distal end and a proximate end, said proximate end of said inner portion remaining disposed within said outer portion when said telescopic recovery member is extended, said distal end of said inner portion comprising said capture arm.

6. A method in accordance with claim 1, wherein the step of engaging comprises engaging said capture arm with a forward end of said submerged device.

7. A method in accordance with claim 1, further comprising the step of adjusting said capture arm to align an aft end of said submerged device with an inner perimeter of said second recovery tube.

8. A method in accordance with claim 1, further comprising the step of engaging a retraction device disposed within said second recovery tube with an aft end of said submerged device for retracting said submerged device and coaxially aligning said submerged device with said second recovery tube.

9. A method in accordance with claim 1, further comprising the step of attracting said submerged device toward said capture arm with a homing device.

10. A method in accordance with claim 1, wherein said underwater recovery vehicle is a submarine and said non-coaxially aligned recovery tubes are torpedo tubes.

11. A method in accordance with claim 1, wherein said submerged device is an unmanned underwater vehicle.

12. A system for recovering a submerged device with an underwater recovery vehicle having a plurality of recovery tubes, said recovery tubes being non-coaxially aligned relative to one another, said system comprising:

a recovery member disposed within a first recovery tube of said plurality of non-coaxially aligned recovery tubes; and a second recovery tube of said plurality of non-coaxially aligned recovery tubes for receiving said submerged device.

13. A system in accordance with claim 12, said recovery member having a proximate end and a distal end, said proximate end of said recovery member remaining within said first recovery tube when said recovery member is extended, wherein said recovery member further comprises a capture arm for engaging said submerged device, said capture arm being pivotally coupled to said distal end of said recovery member.

14. A system in accordance with claim 12, wherein said recovery member is a telescoping recovery member comprising an outer portion and an inner portion disposed within said outer portion, said inner portion having a distal end and a proximate end, said proximate end of said inner portion remaining disposed within said outer portion when said telescopic recovery member is extended, said distal end of said inner portion comprising a capture arm pivotally coupled to said distal end of said inner portion.

15. A system in accordance with claims 12, wherein said underwater recovery vehicle is a submarine.

16. A system in accordance with claim 12, wherein said submerged device is an unmanned underwater vehicle.

17. A system in accordance with claim 12, wherein at least one of said recovery member and said submerged device comprise a homing device for attracting said submerged device toward said recovery member.

18. A system in accordance with claim 13, further comprising a retraction device disposed within said second recovery tube, for retracting said submerged device and coaxially aligning said submerged device with said second recovery tube.

19. A method for recovering a submerged device with an underwater recovery vehicle having a plurality of recovery tubes, said method comprising the steps of:

extending a recovery member having a proximate end and a distal end from a first recovery tube of said plurality of recovery tubes, said proximate end of said recovery member remaining within said first recovery tube;

pivotally extending a capture arm from said distal end of said recovery member;

engaging said capture arm with said submerged device;

aligning said submerged device with a second recovery tube of said plurality of recovery tubes; and retracting said recovery member to recover said submerged device into said second recovery tube.

20. A method in accordance with claim 19, wherein said step of step of pivotally extending said capture arm comprises pivotally extending said capture arm to form an obtuse angle with said recovery member.

21. A method for recovering a submerged device with an underwater recovery vehicle having a plurality of recovery tubes, said method comprising the steps of:

extending a recovery member having a proximate end and a distal end from a first recovery tube of said plurality of recovery tubes, said proximate end of said recovery member remaining within said first recovery tube;

extending a capture arm from said distal end of said recovery member;

engaging said capture arm with a forward end of said submerged device;

aligning said submerged device with a second recovery tube of said plurality of recovery tubes; and retracting said recovery member to recover said submerged device into said second recovery tube.

22. A system for recovering an submerged device with an underwater recovery vehicle having a plurality of recovery tubes, said system comprising:

a recovery member disposed within a first recovery tube of said plurality of recovery tubes, said recovery member having a proximate end and a distal end, said proximate end of said recovery member remaining within said first recovery tube when said recovery member is extended, said recovery member comprising a capture arm for engaging said submerged device, said capture arm being pivotally coupled to said distal end of said recovery member; and a second recovery tube of said plurality of recovery tubes for receiving said submerged device.

23. A system in accordance with claim 22, wherein said recovery member is a telescoping recovery member comprising an outer portion and an inner portion disposed within said outer portion, said inner portion having a distal end and a proximate end, said proximate end of said inner portion remaining disposed within said outer portion when said telescopic recovery member is extended.

* * * * *